US006523653B2

(12) United States Patent
Roegner

(10) Patent No.: US 6,523,653 B2
(45) Date of Patent: Feb. 25, 2003

(54) PORTABLE REMOVABLE CARRYING CASE ORGANIZER

(76) Inventor: DeAnna Roegner, 774 Mays Blvd., #10-405, Incline Village, NV (US) 89451-9613

( * ) Notice: Subject to any disclaimer, the term of this patent is extended or adjusted under 35 U.S.C. 154(b) by 0 days.

(21) Appl. No.: 09/766,458

(22) Filed: Jan. 19, 2001

(65) Prior Publication Data

US 2002/0096409 A1 Jul. 25, 2002

(51) Int. Cl.[7] ..... A45C 3/00
(52) U.S. Cl. ..... 190/109; 383/37; 383/106
(58) Field of Search ..... 190/109, 107, 190/108, 110, 111; 150/111–115, 120; 383/37, 105, 106, 117, 39

(56) References Cited

U.S. PATENT DOCUMENTS 4,852,783 A * 8/1989 Bryden et al. ..... 150/149
4,887,751 A * 12/1989 Lehman ..... 190/1
5,706,935 A * 1/1998 Lorton ..... 150/117
5,779,033 A * 7/1998 Roegner ..... 205/464
5,799,791 A * 9/1998 Harley ..... 190/102
5,890,587 A * 4/1999 Roegner ..... 206/6.1
6,168,022 B1 * 1/2001 Ward et al. ..... 206/440
6,193,034 B1 * 2/2001 Fournier ..... 190/107

* cited by examiner

*Primary Examiner*—Stephen P. Garbe
*Assistant Examiner*—Wen Nao
(74) *Attorney, Agent, or Firm*—Freling E. Baker

(57) ABSTRACT

A portable multi-pocket organizer for a carrying case of the type having a primary shell of pliable material formed of a pair of substantially identical primary half shells connected together for hinging along a common side and forming a primary receptacle, a multi-pocket assembly of pliable material that removably stores within the carrying case, the multi-pocket assembly device includes a rectangular pocket back panel having a front face and a back face, at least two open mesh pockets on the front face of the pocket back panel, and the open mesh pockets have openings oriented in a common direction, a removable auxiliary case in each open mesh pocket, each case formed of a primary shell of pliable material, the primary shell formed of a pair of opposed half shells connected together for hinging along a common side and forming a receptacle, each said primary shell having an outer fastener so that the outer fastener provides a means for opening and securing each auxiliary case.

22 Claims, 11 Drawing Sheets

PORTABLE REMOVABLE CARRYING CASE ORGANIZER

BACKGROUND OF THE INVENTION

The present invention relates to carrying cases and pertains particularly to a case having a portable removable organizer having an improved arrangement of multiple pocket assemblies for carrying cases in kit form.

People often carry many items that are often placed loosely in a suitcase when traveling. These items are usually disorganized and difficult to locate. Some of these people are also engaged in a profession or trade that entails carrying with them numerous business or trade related items such as toiletries, cosmetics, samples or tools. Often, these items are transported to a business or work site in a special carrying case specifically designed for these items.

In the above identified parent application, and in my prior U.S. Pat. No. 5,897,209, I disclose a multi-pocketed carrying case having a variety of pockets in removable inserts, which is convenient for an overnight bag. It is particularly convenient for carrying toiletries, cosmetics and personal items for travel. However, experience has shown that even further improvements in inserts for overnight carrying cases is desirable. In particular it is desirable to have one easy organizer that provision for carrying jewelry and cosmetics and provides everything visible and with easy access.

There is a need for a carrying case that is adaptable to carry many related or unrelated items in an organized fashion, and have provision for carrying jewelry and cosmetics and provides everything visible and with easy access. It would be desirable to have a case with multiple pockets for holding articles of different sizes in a secure manner and that also allows ease of accessibility.

SUMMARY OF THE INVENTION

It is the primary object of the present invention to provide an improved removable carrying case organizer insert with multiple pockets for holding articles of different sizes secure and readily accessible.

A multi-pocketed organizer insert for a carrying case comprises a multi-pocket panel assembly secured to the back panel of the half shell and comprising a pleated or zig zag folded panel forming overlapping front and back panels, these back panels are secured to another back panel forming a plurality of pockets having spaces therebetween, and a closure panel secured along an edge to the back panel to thereby overlap and close the plurality of pockets.

Another embodiment of the carrying case comprises an adjustable and expandable case for carrying many types of items in an organized fashion, and particularly suited for carrying a few clothing items. This embodiment of the invention has multiple pocket assembly devices for holding articles of different sizes in a secure manner that are readily accessible to a user. This embodiment of the invention includes, in kit form, multiple accessory storage devices that include various multiple pocket assembly designs and a portable case with adjustable partitionable members.

BRIEF DESCRIPTION OF THE PREFERRED EMBODIMENTS

The above and other objects and advantages of the present invention will become apparent from the following description when read in conjunction with the accompanying drawings wherein.

DETAILED DESCRIPTION OF THE PREFERRED EMBODIMENTS

Figure 1:
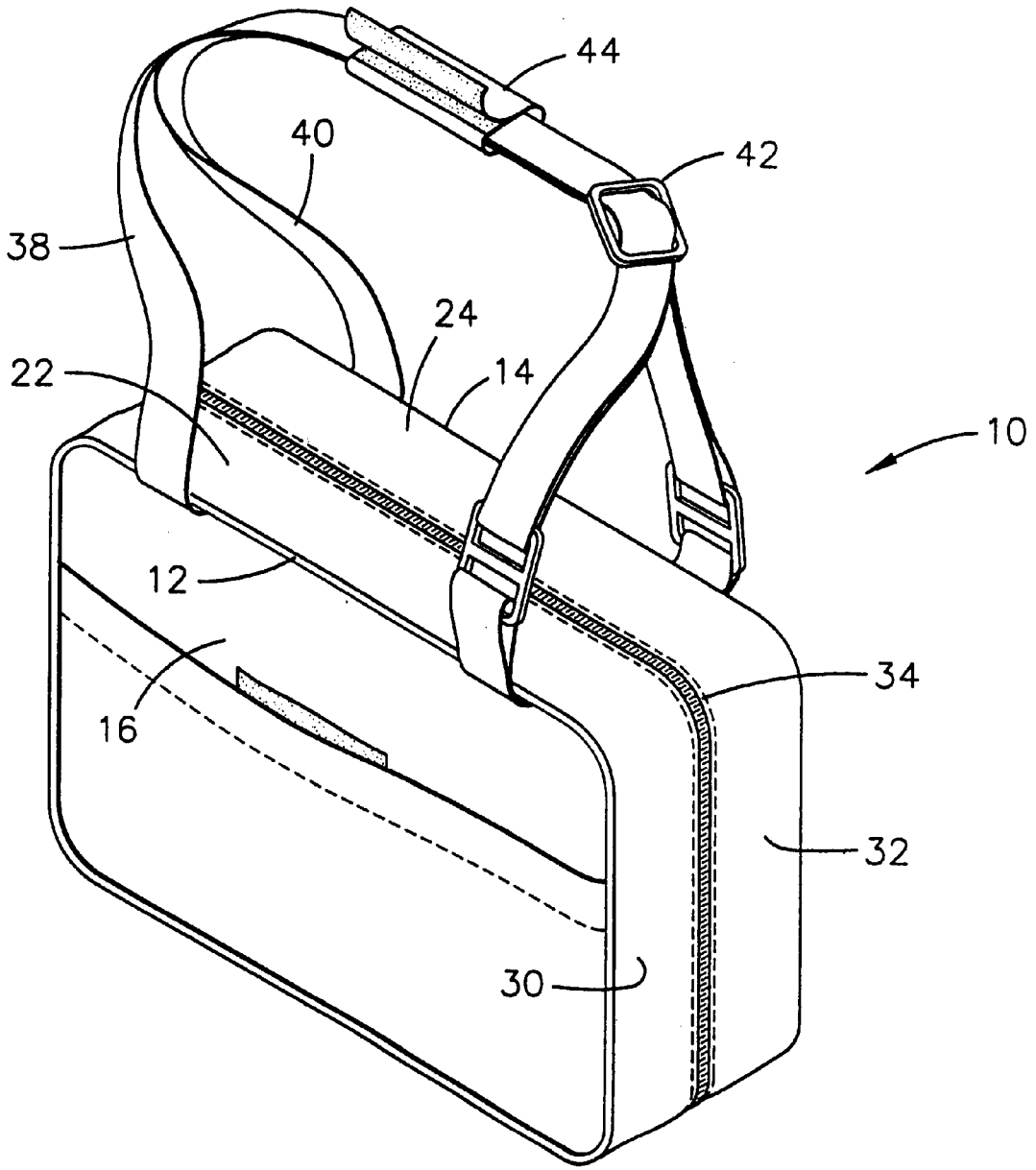
FIG. 1 is a perspective view of an exemplary preferred embodiment of a carrying case embodying the invention with the case closed.

Referring to FIG. 1 of the drawing, a carrying case in accordance with one aspect of the invention is illustrated and designated generally by the numeral 10. The case is preferably constructed of a pliable material, such as leather, vinyl, or any of the suitable woven materials, now widely used for suitcases and the like. The case comprises a primary shell formed of a pair of substantially identical half shells 12 and 14, hinged together along a common side and forming a primary receptacle. Each shell is formed of a generally rectangular back panel 16 and 18 respectively, with a bottom panel 20 which is preferably common to both half shells with a continuous strip forming top panels 22 and 24, end panels 26, 28, 30 and 32, respectively, for forming each of the half shells into the primary receptacle. The half shells are secured together along edges of the side and top panels by zipper elements 34 and a slider 36 at one side or end of the zipper elements. The bottom panel 20 flexes so as to function as a hinge for the two half shells.

Each half shell is provided with an elongated carrying strap 38 and 40, respectively, which detachably secure together at a midpoint and are preferably adjustable in length to serve as either a handle or a shoulder strap. The strap 38, for example, is preferably secured at one end directly to the side of the shell and at the other end through a slip loop and to the shell with the opposite end adjustably secured by a buckle which may be positioned underneath a hand grip 44. The hand grip 44 is of conventional construction and preferably forms a slip sleeve over one of the straps and opening sleeve secured together in a closed position around the other strap by suitable means, such as hook and loop fastening means, such as that available under the trademark VELCRO. This enables the straps to be adjusted in length so that they may serve as a hand carrying strap or shoulder strap, as desired.

Figure 2:
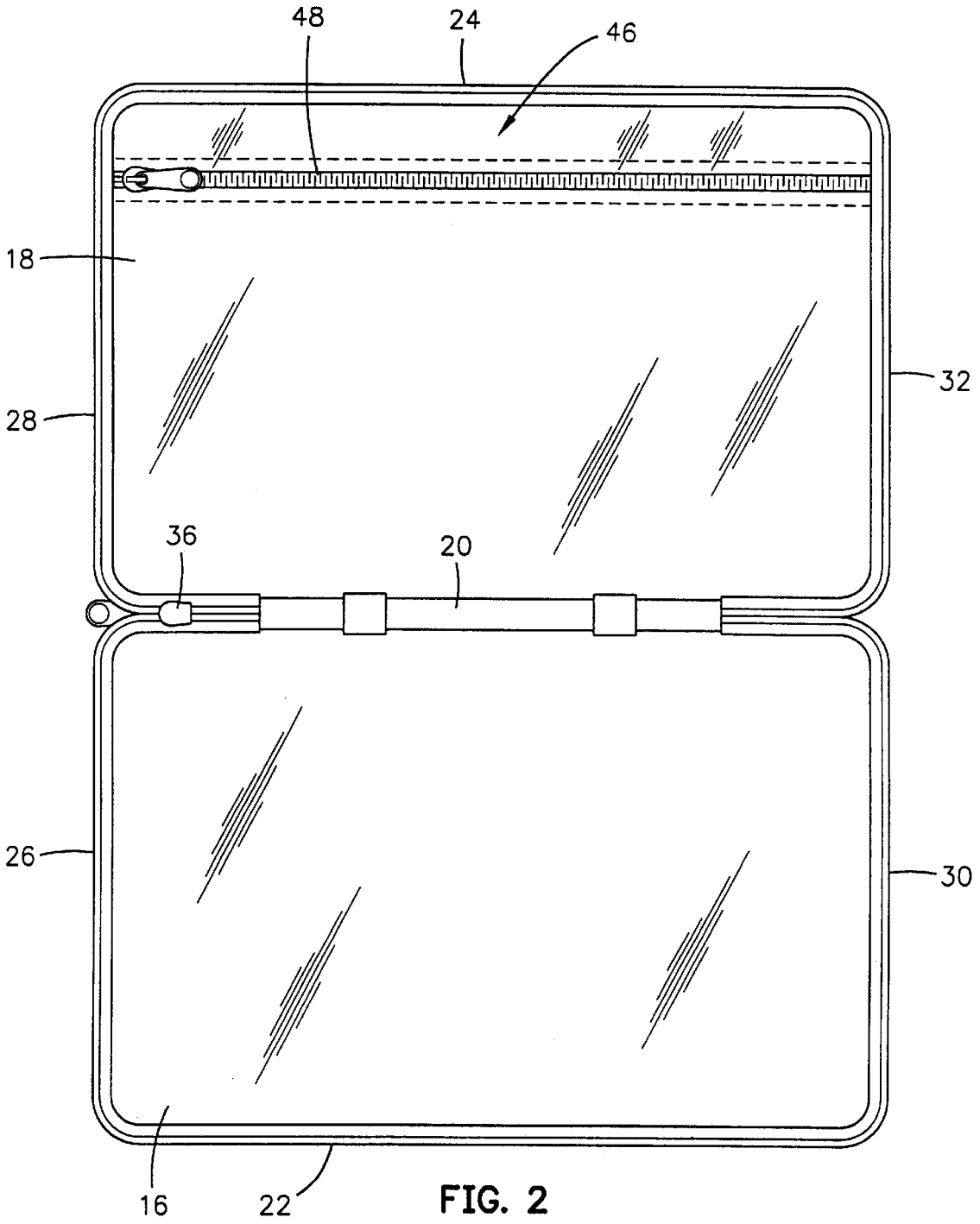
FIG. 2 is a plan view of the embodiment of FIG. 1 with the case open.

As seen in FIG. 2, the overall carrying case is provided with at least one pocket assembly designated generally by the numeral positioned or formed in one of the respective half shells. The pocket assembly is in a preferred form formed on a common back panel that extends into and may preferably form at least a partial liner in each receptacle of each half shell. The illustrated pocket may preferably be formed of a transparent material, such as vinyl or the like and includes a closure 48, such as a zipper as shown. A second similar pocket (not shown) may be formed in the other half shell and would preferably open toward the top of the case.

Figure 3:
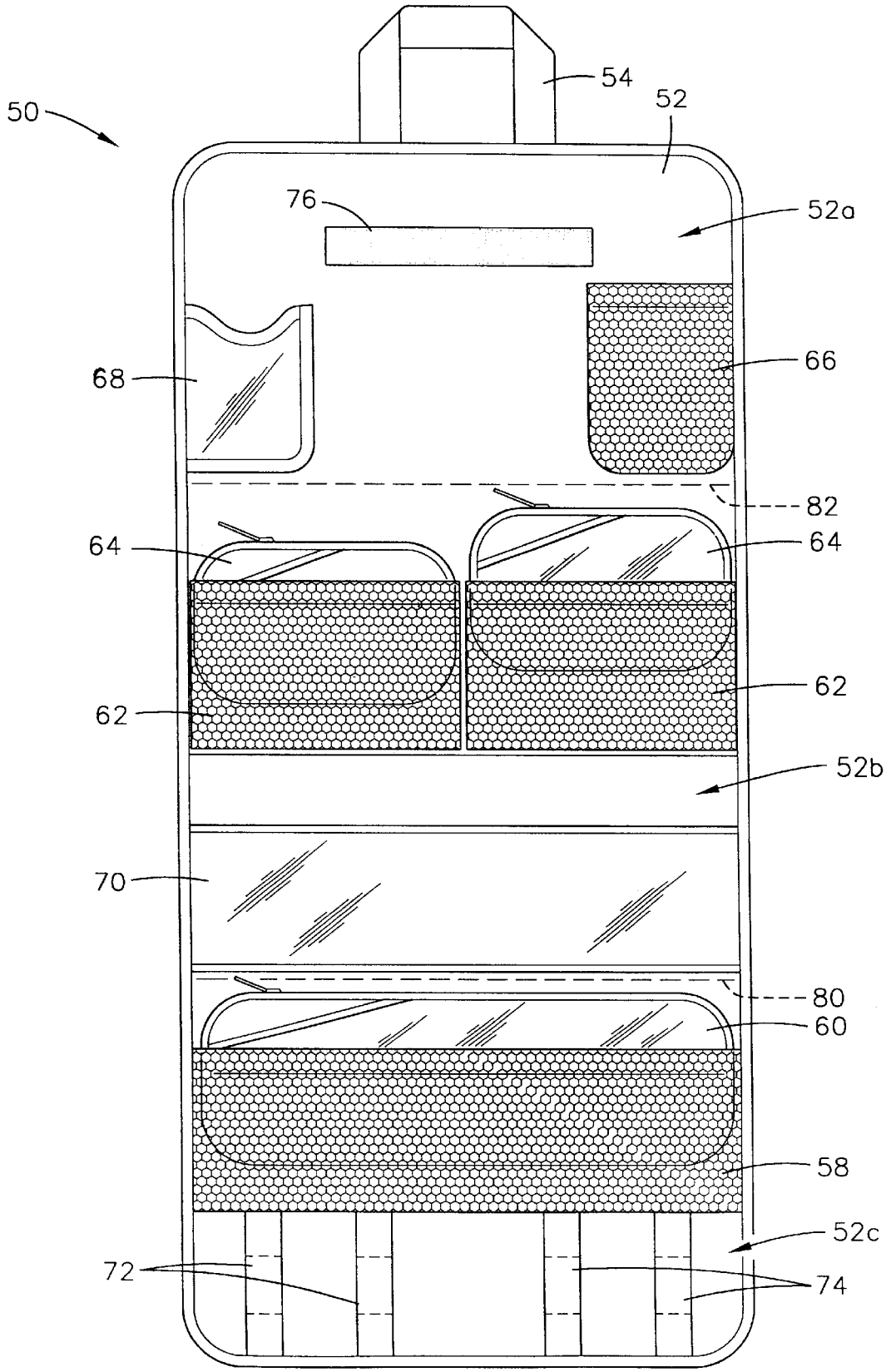
FIG. 3 is a front elevation view of one removable pocket assembly in accordance with the invention configured for storage in one of the receptacles formed by a half shell shown in FIG. 1.
Figure 4:
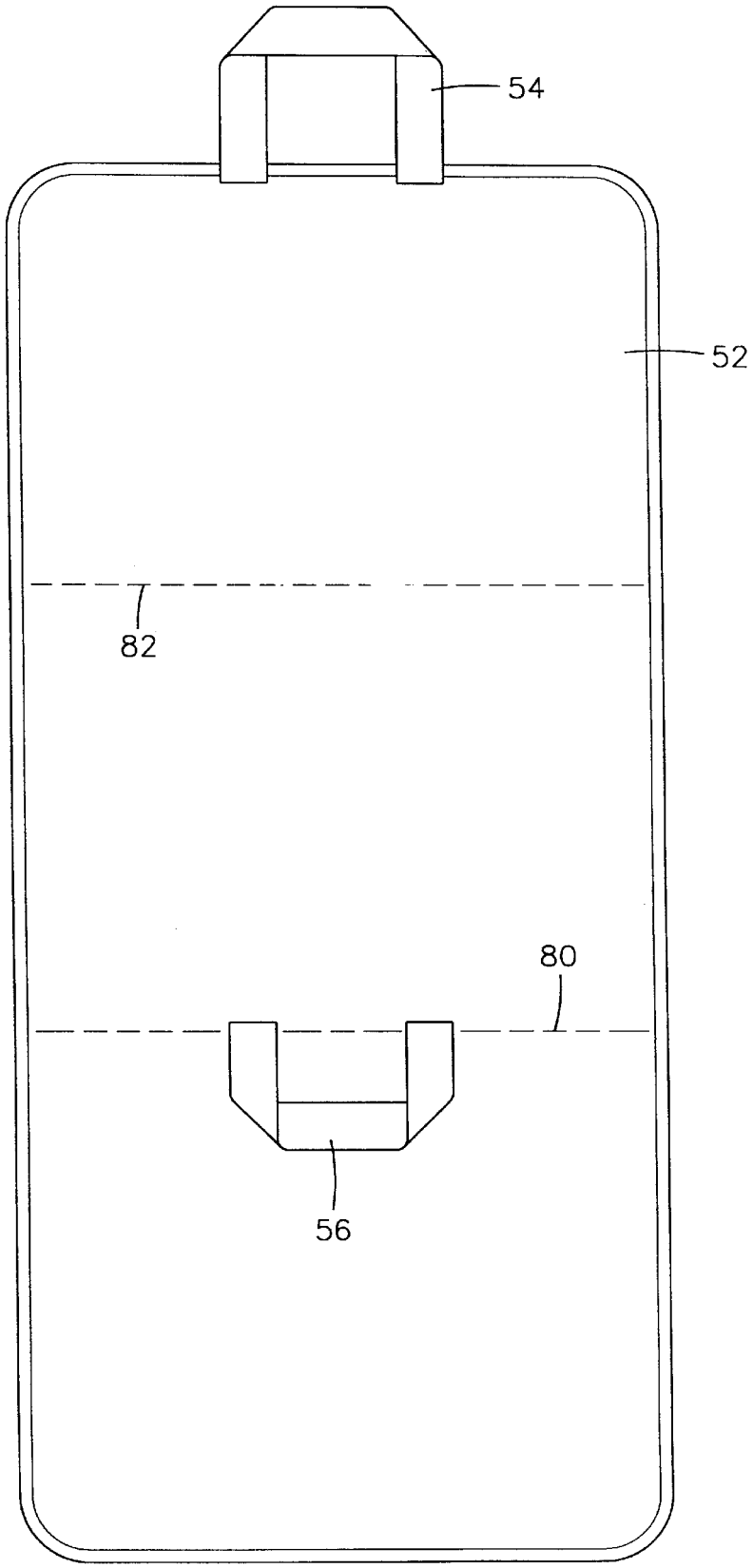
FIG. 4 is a back elevation view of the removable pocket assembly shown in FIG. 3.

Referring to FIGS. 3 and 4, a front and a back view of an unfolded hanging multi-pocketed organizer assembly in a storage bag form 50 in accordance with a principal aspect of the invention is shown that can be folded and inserted in one of the half shells of the case 10. This form of the multi-pocket assembly has multiple storage pockets distributed about the face of a common back panel 52 and preferably opening in a common direction. The back panel of the pocket assembly is provided with a hanging strap and handle 54 at a top edge and a hand handle 56 on the back of the panel at a fold line about one third the distance from the bottom edge of the panel. A first open mesh pocket 58 is mounted on a lower or bottom section of the back panel and is provided with a removable auxiliary case 60. A second, or pair of open mesh pockets 62 are mounted side by side on a central section of the back panel and are each equipped with a removable auxiliary case 64. A third open mesh pocket 66 is mounted on an upper or top section of the back panel and may be used for holding cotton balls or the like. A small transparent pocket 68 is mounted on the top section of the panel on the opposite side of the panel. This pocket is designed to hold any number of items such as Q-TIPS.

A full width open transparent pocket 70 is mounted on the lower portion of the center section of the back panel for holding cosmetic accessories and the like. Two pairs of elastic straps 72 and 74 are attached at multiple positions to the lower portion of the bottom section of the back panel forming multiple loops for mounting large cosmetic brushes, combs and the like.

A jewelry case, as illustrated in FIGS. 5–9, detachably mounts to a hook and loop strip 76 at the top of the upper portion of the back panel between pockets 66 and 68. The strip 76 is preferably hook and loop type such as commonly available under the trademark VELCRO. The jewelry case is removable to enable it to be separately secured or stored in a hotel safe. In a preferred construction, the organizer assembly is formed on a common back panel 52 as described above, which may be a transparent or opaque material and is pliable for ease of folding the assembly into a folded arrangement for ease of storing in the case 10 and to separately carry as a tote. The pockets on the face side of the pocket assembly 50 are arranged to enable the panel to fold about fold lines 80 and 82 (which divide the panel into top, central and bottom panels) so that pocket 58 and case 60 on the lower section 52*c* nestle below pockets 62 on center panel 52*b*. This folding presents the handle 56, on the back of the panel, to a position adjacent handle 54 when the upper section 52*a* is folded down over the lower section. The handles can then be grasped in one hand to enable one to carry the assembly as a tote. The assembly can be easily hanged from a hanger when in the unfolded condition as shown in FIGS. 3 and 4 to provide easy access to all jewelry, cosmetics and toiletry items.

The pockets of a first of the multi-pocket assembly in this embodiment is illustrated as extending from the bottom of the back panel, as viewed in FIG. 3, to the top of the back panel so that when hanging in FIG. 3, the openings of the pockets are positioned toward the top of the back panel. As will be appreciated, the pocket assemblies are formed such that the pockets open in a common direction when viewed as in FIG. 3 or 4, so that the case can be hung in a manner that all pockets conveniently open to the top or upward.

Figure 5:
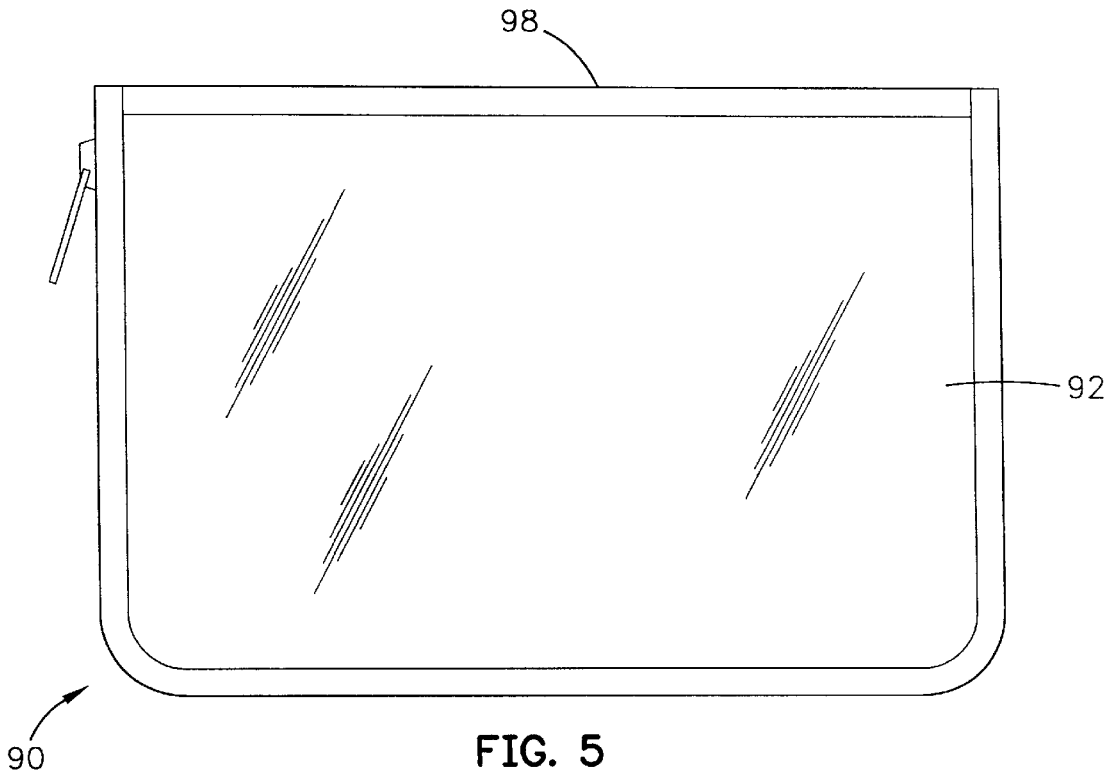
FIG. 5 is a front elevation view of the removable jewelry case configured for detachable attachment to the to the removable pocket assembly shown in FIG. 3.
Figure 6:
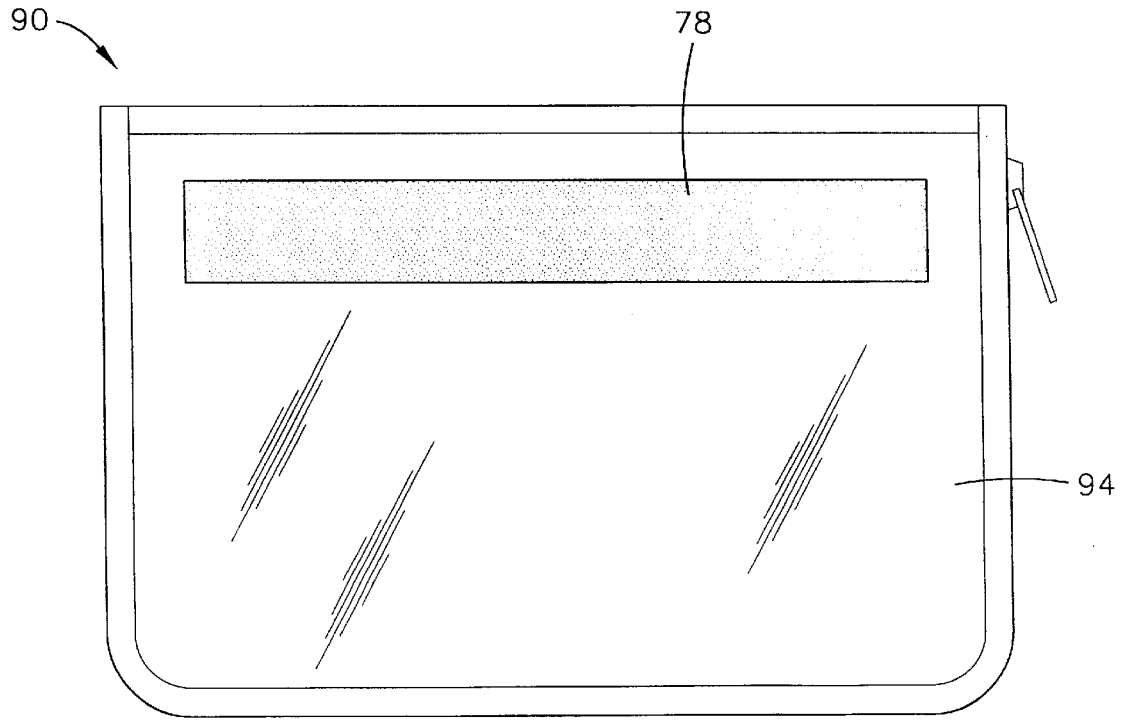
FIG. 6 is a back elevation view of the removable jewelry case shown in FIG. 5.

Referring now to FIGS. 5–9, the jewelry case is illustrated and designated generally by the numeral 90. The jewelry case is best seen in FIGS. 5 and 6 from front and back respectively, comprise a primary support and closure panel formed of one or more rectangular panels secured together forming front and back covers 92 and 94. The front and back panels as illustrated may be a single panel folded along an edge 96, or it may be two separate panels secured along this edge. The shell is preferably constructed of a pliable material such as leather, vinyl, or any suitable woven materials now widely used for handbags and carrying cases and the like. However, in the preferred embodiment, the outer shell is made of a transparent pliable material to enable easy viewing of the internal contents as will be explained.

A hook and loop strip 78 is secured to the back cover panel as shown in FIG. 6 to properly engage the velcro strip 76 on the panel 52 as shown in FIG. 3. This enables the detachable securement of the jewelry case to the primary organizer as previously explained. The case is formed with a closure comprising zipper elements 100 and 102, with a zipper slider 104 for closing and opening the case.

Figure 7:
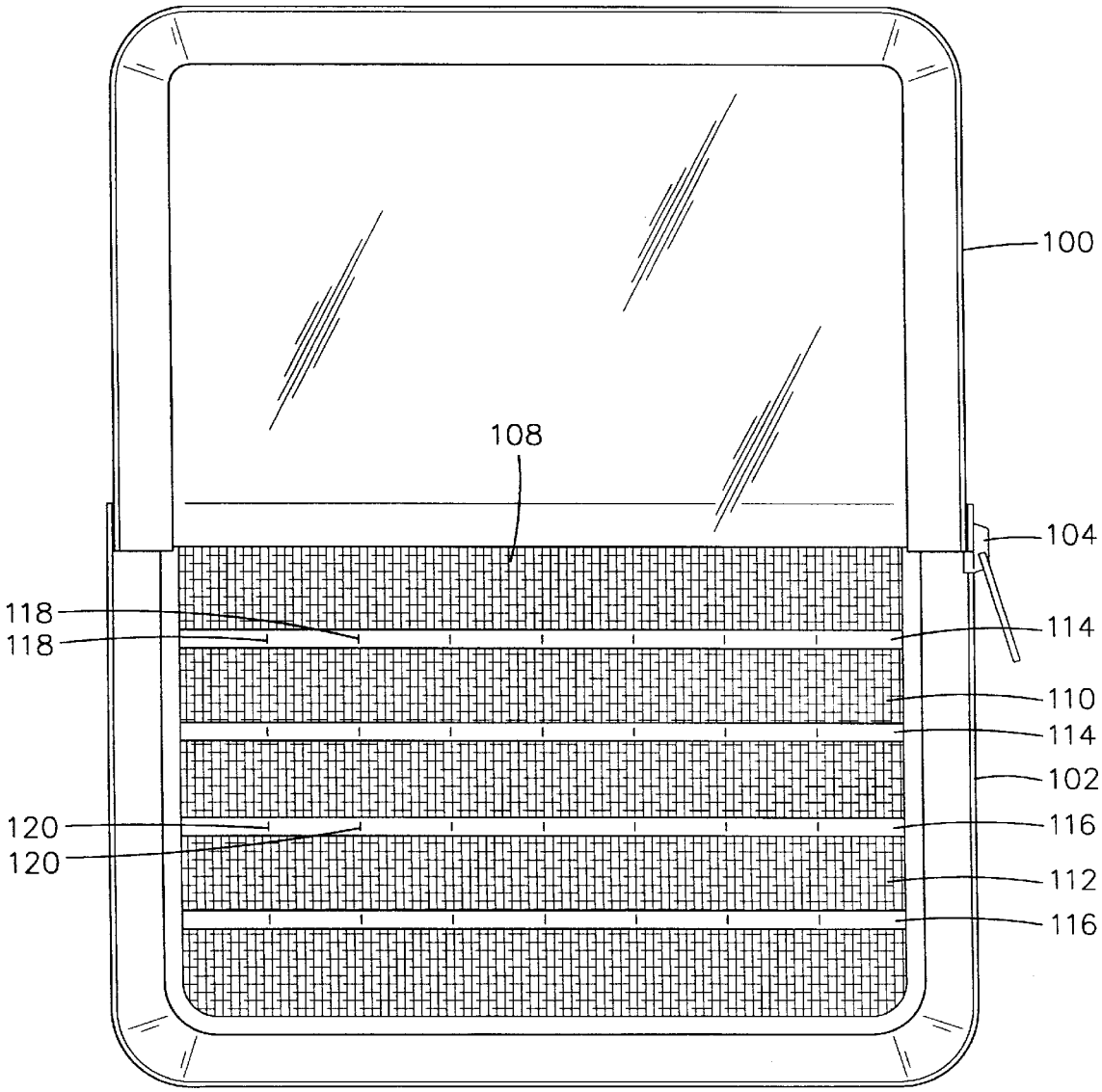
FIG. 7 is a front elevation view of the removable jewelry case shown in FIG. 5 with the front cover open to reveal details of a first jewelry mounting panel.
Figure 8:
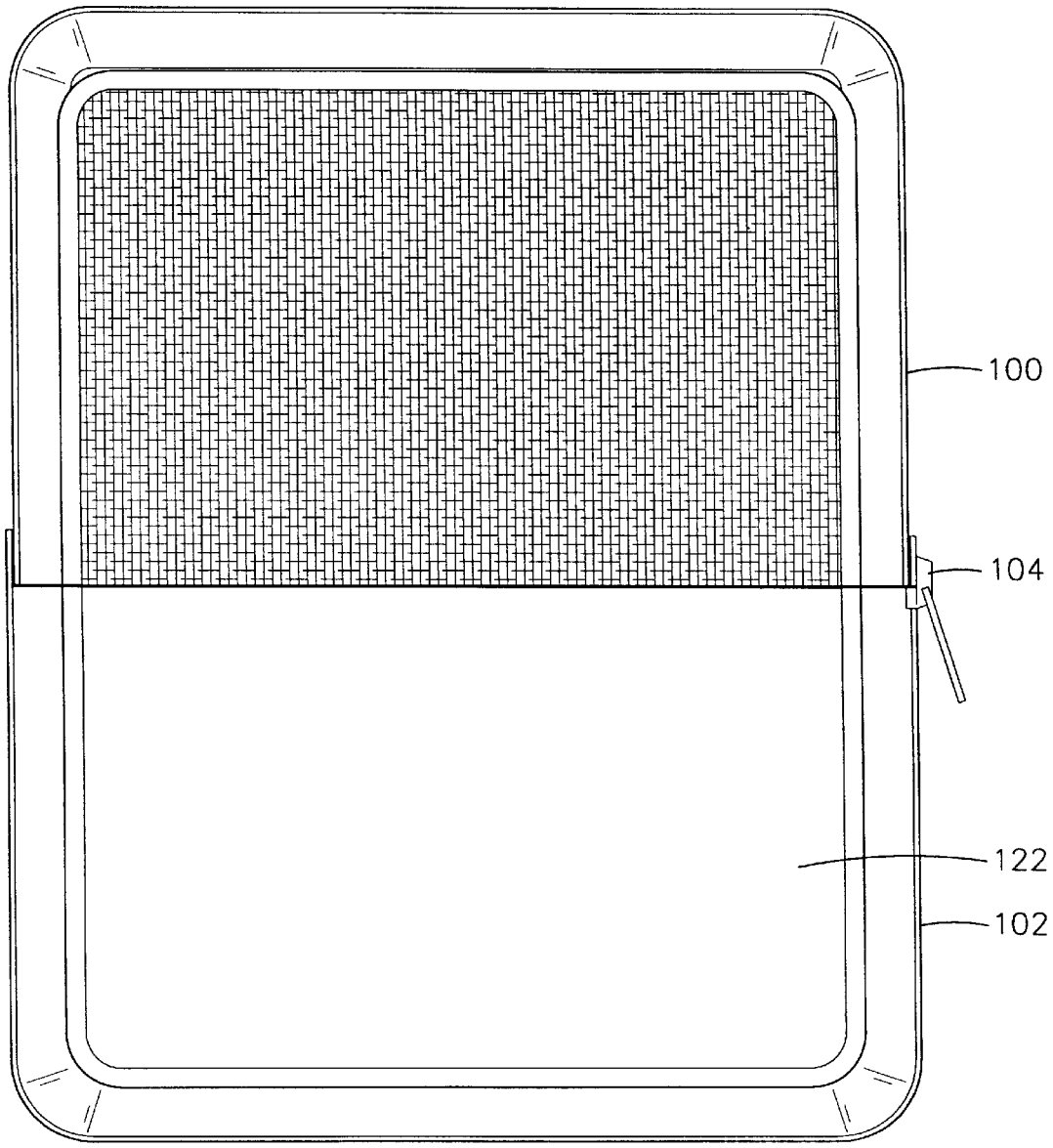
FIG. 8 is a front elevation view of the removable jewelry case shown in FIG. 5 with the first jewelry mounting panel open to reveal an interior cover panel.

An open mesh jewelry mounting panel 108 is mounted within the case and pivots or hinges between a position as shown in FIG. 7 and FIG. 8. A front surface of the open mesh jewelry mounting panel is formed with two mesh strips, 110 and 112, each of which is finished on the side edges with finishing tapes, 114 and 116, respectively. These strips are secured multiple positions, 118 on band 110 and 120 on band 112 to form mounting tubes on the face of the main panel 108. These are convenient for the mounting of the clip-type earrings and the like. They may also be used for the mounting of other items. The open mesh provides for convenient mounting of stud-type earrings.

Figure 9:
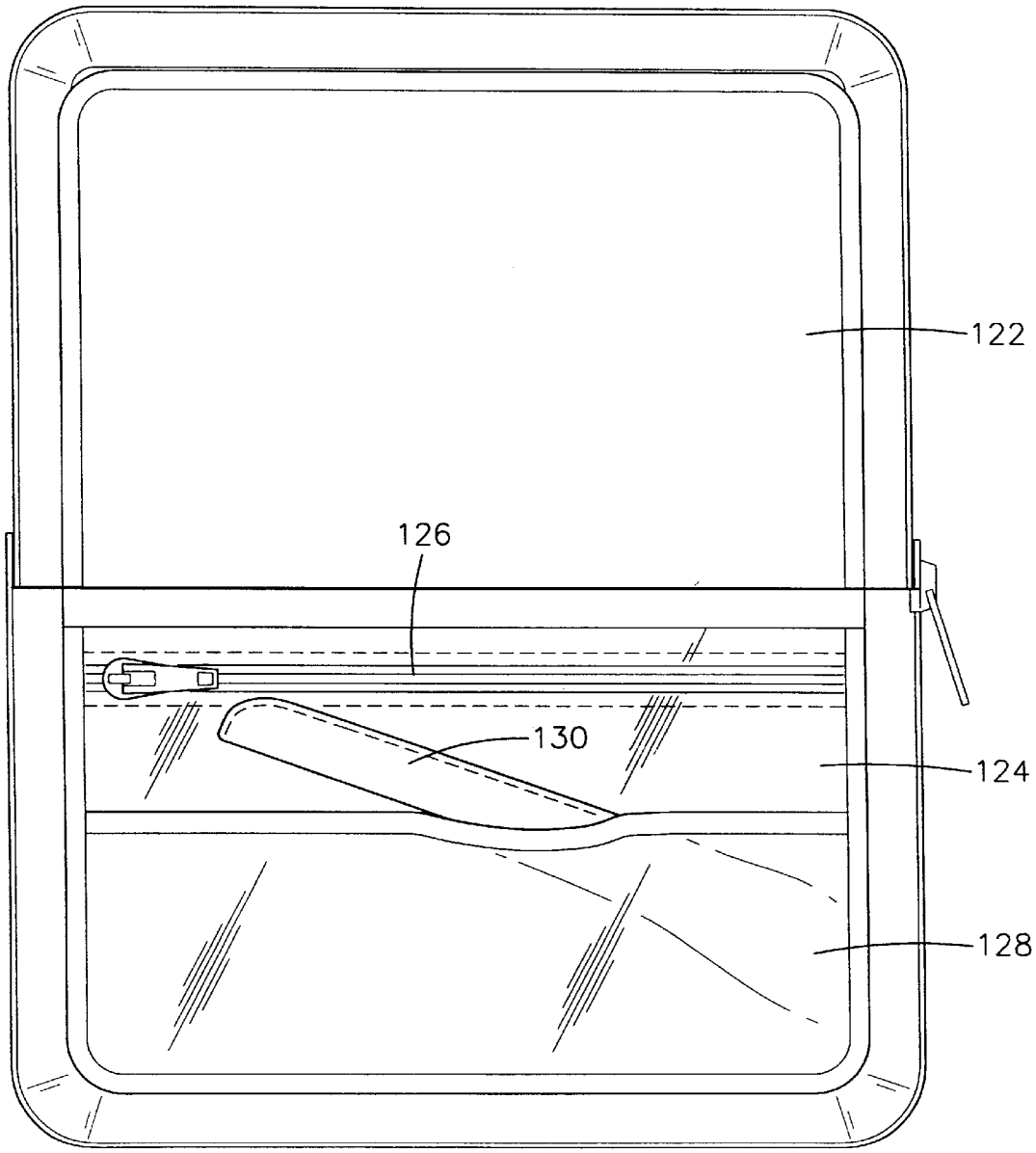
FIG. 9 is a front elevation view of the removable jewelry case shown in FIG. 5 with the first interior cover panel open to reveal an interior pocket with a ring mount and a pocket with a transparent cover.

A protective cover panel 122, as shown in FIGS. 8 and 9, is secured along one edge within the protective cover and protectively separates the open mesh mounting panel from the inside surface of the back panel, 94. The inside surface of the back panel, as shown in FIG. 9, is formed with an envelope-type slit pocket 124 having a zipper closure 126. The pocket is preferably formed by means of a transparent pliable panel, secured along its peripheral edges directly to the peripheral edges of the back panel. This pocket may conveniently hold any suitable or desirable items of jewelry.

A second envelope-type open-type pocket 128 is formed on or over the top of the aforementioned pocket 124. This pocket is preferably open-top, and is formed by a panel having approximately one-half of the height of the lower portion of the back panel secured along the peripheral edges thereof to the back panel.

Mounted within this pocket is a one or more ring mounting studs 130 having a suitable diameter that is slightly tapered for the mounting of a plurality of rings. The ring mounting stud is preferably formed of a pliable fabric-like cover over a suitable filler or stuffing providing a gently tapered stud of sufficient length and yield ability to mount a plurality of rings. The stud is preferably tethered within the pocket by means of a strap on one end, not shown. This enables the stud to be conveniently pivoted into and out of the pocket for the mounting and removal of rings, yet prevent it from being displaced from the jewelry case. The stud 130 may also be secured along the right hand edge as shown in FIG. 9 to the backing panel by suitable stitching or the like. It may also be detachably attached, such as by hook and loop fastening means.

In operation, the jewelry organizing case may be filled with a large selected number of jewelry items and in the various compartments and sections. The case may then be detachably mounted on the primary organizer, as briefly discussed above, to be carried along with other items. It may also be detached therefrom for ease of carrying in a purse or for secure storage in a hotel safe or the like.

Figure 10:
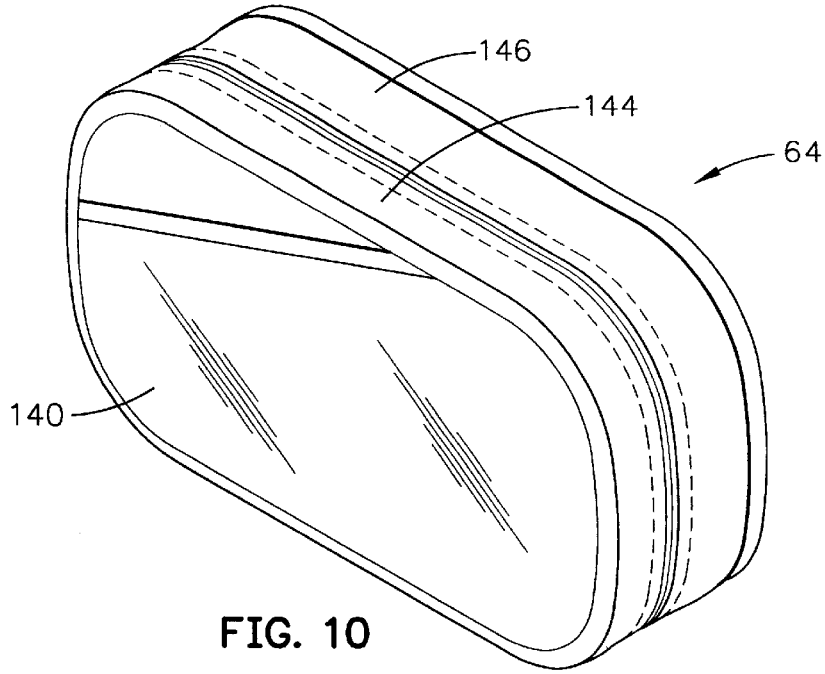
FIG. 10 is a perspective view of another removable case configured for storage in one of the receptacles formed by a half shell shown in FIG. 1.
Figure 11:
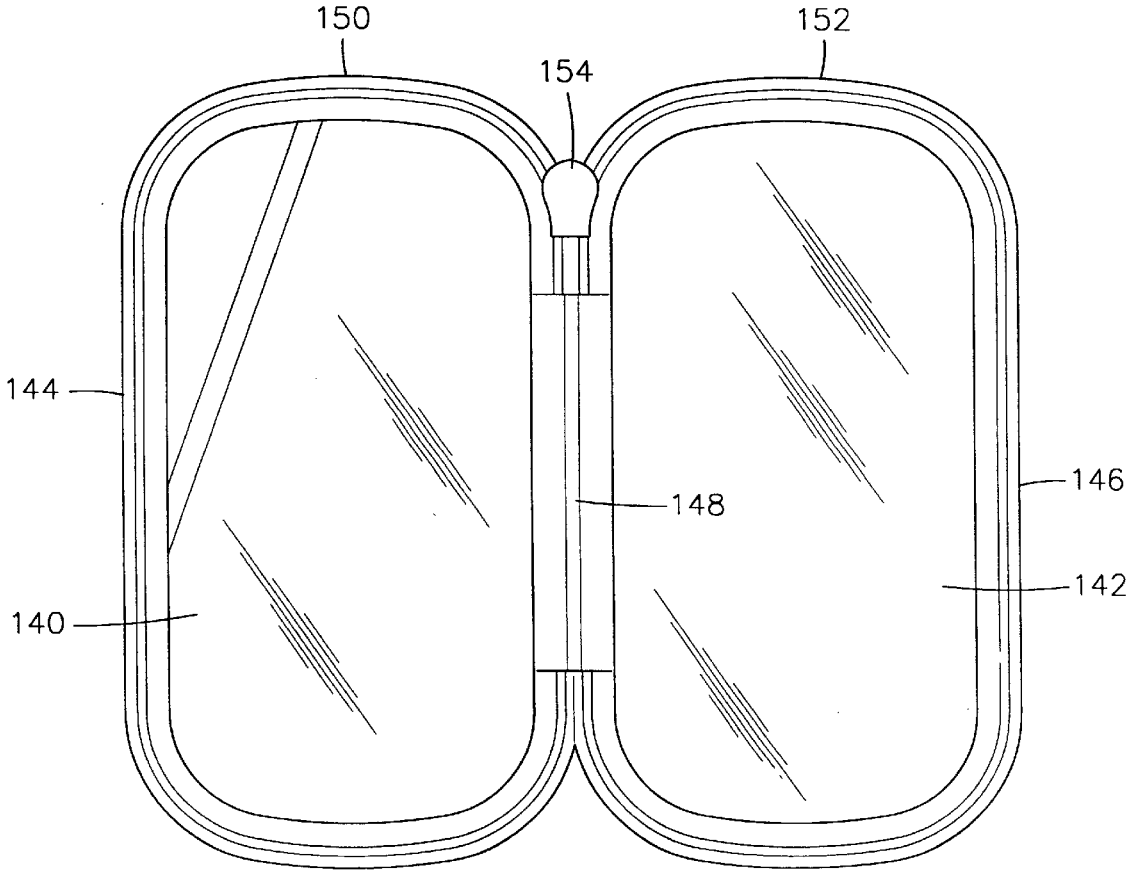
FIG. 11 is a front elevation view of the removable case shown in FIG. 10 with the front cover open to reveal details of the interior of the case.

Referring to FIGS. 10 and 11, a removable auxiliary case 64 as shown in FIG. 3 for removably inserting in the open mesh pockets is illustrated. The auxiliary cases are substantially identical except for size and only one will be described in detail. The case as illustrated is formed of two half-shells, each comprising a panel 140 and 142 with a somewhat rectangular configuration with rounded comers. The panels each connect to a peripheral panel 144 and 146, respectively, which are secured around the periphery thereof, forming top end and bottom walls. The two panels may be formed of a unitary panel of fabric or secured together at 148 to form a hinge structure. Zipper elements 150 and 152 are secured to the butting edges of the panels 144 and 146, providing a closure for the case. A slider 154 of the usual construction is provided for opening and closing the zipper in the usual manner.

Figure 12:
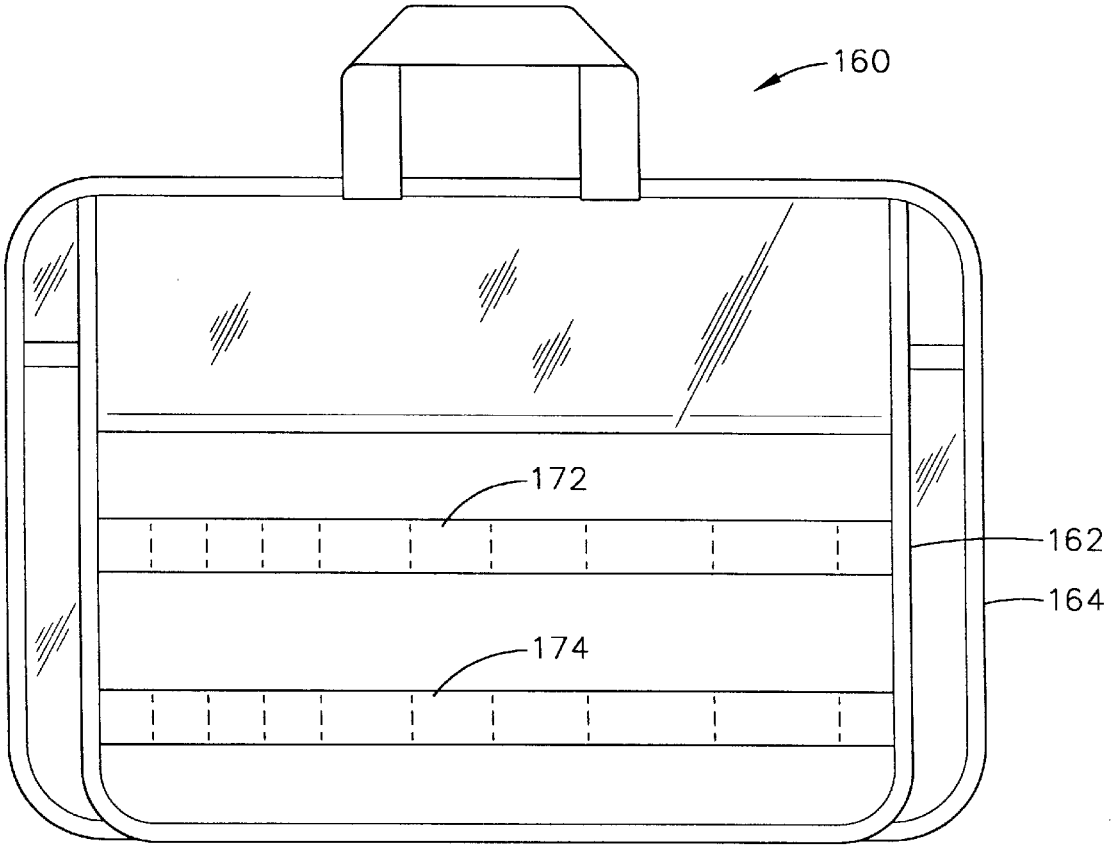
FIG. 12 is a front elevation view of another removable pocket assembly configured for storage in one of the receptacles formed by a half shell shown in FIG. 1.

One of the panels 140 and 142 may be considered the front panel and is preferably transparent. This enables easy viewing of the contents of the case without removing and opening of the case. The other panel is preferably of a fabric material covered on the inside by a plastic panel or a coating, such as vinyl or the like. These cases as discussed above are Referring to FIGS. 12 and 13, frontal elevation views when closed and open of a removable pocket assembly 160 is shown that is configured for storage within one of the receptacles formed by one of the half shells of a primary case. This pocket assembly is provided with a pocket closure cover or panel 162 closeable over a pocket panel 164. The pocket panel is shown open with internal securable storage pocket 166 and has a loop strap 168 for hanging on a hook (not shown). The pocket assembly can have one or more hook and loop fastener means (not shown) attached to back side of the lower back panel 164 so that it can be secured to one of the back panels of either the primary or auxiliary half shell sections.

The folding cover pocket panel 162 has at least one hook and loop fastener 168*a* that mates with hook and loop fastener 168*b* on the pocket panel that secures the pocket assembly in a closed position that also maintains stable placement of articles in the lower panel section pockets as discussed below. The pocket assembly 160 can be provided with another hanging loop 170 so that it can be removed from the case with ease and can be another way for carrying or hanging from a hanger or suitable hook (not shown). The internal zipper fastened internal pocket 166 (FIG. 13) has a common back panel with a cover panel 162 in an open position. On the back side (FIG. 12) of the foldable cover pocket panel 162 are a pair of elongated elastic straps 172 and 174 secured such as by stitching at multiple points along the face of the panel to form a plurality of loops for holding additional small articles such manicuring implements that can include tweezers, nail files, toe clips, nail clips and the like. These multiple loops have limited elasticity to allow ease of securing to or obtaining from the case any of these small articles. These multiple loops are selectively secured at locations so as to form fit a particular small article.

Figure 13:
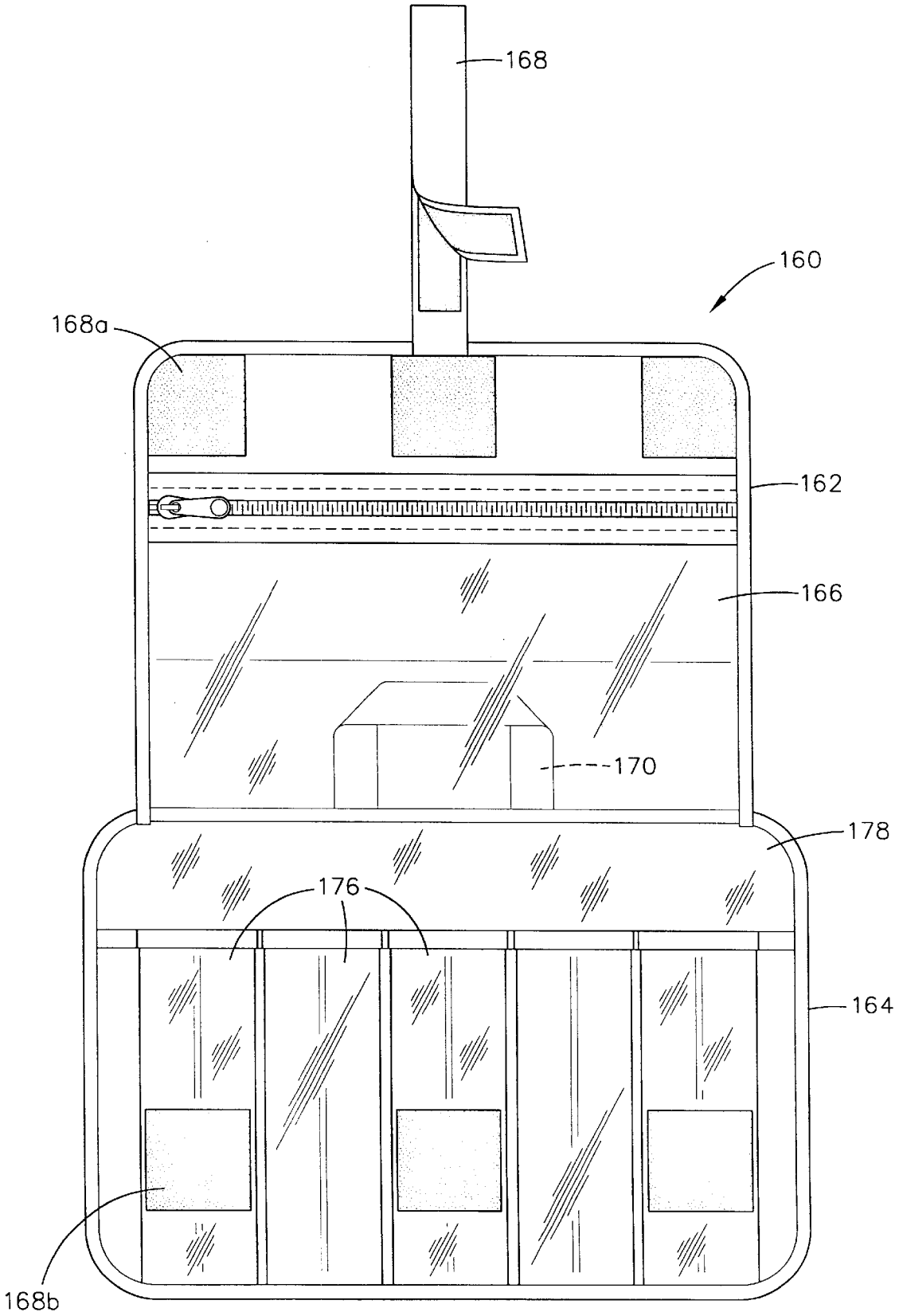
FIG. 13 is a front elevation view of the removable pocket assembly shown in FIG. 12 with the front cover open to reveal details of the interior of the pocket assembly.

The bottom sectional portion of the multiple pocket assembly 160 has multiple open top pockets 176 as shown in FIG. 13. These multiple pockets 176 are formed by a pocket back panel 178 with a folded overlapping accordion-like pockets attached as a fore panel. The fore panel forming pockets 176 is secured by suitable bonding or sewing along partitioning lines to a common panel 178. Pocket forming front panel folds on the sides making expandable open top pockets and expandable open side pockets between the open top pockets. This allows articles to be placed inside the open top pockets and in the open side pockets between the open top pockets. Such structure is more fully disclosed and discussed in my U.S. Pat. No. 5,897,209, incorporated herein by reference. This form of the multiple pocket assembly is suitable for use as a personal care organizer for storage of nail care implements, shampoo & hair conditioner, tooth paste, tooth brush holder and the like.

The opposite side of the pocket is formed with a folded side pocket panel portion or section and an adjacent aft panel portion. The aft panel portion is preferably secured along a proximate center line to the back panel. The remaining pockets, as can be seen in FIG. 13, are similarly constructed with collapsed or folded sides such that when the pocket is partially filled an adjacent space between adjacent pockets form an open sided pocket and is available for the placement of additional articles. However, the pockets are constructed so that they can be completely filled, such that no additional space or open sided pockets exist between adjacent pockets.

While I have illustrated and described my invention by means of specific embodiments, it is to be understood that numerous changes and modifications may be made therein without departing from the spirit and the scope of the invention as shown in the appended claims.

What is claimed is:

1. A first multi-pocket assembly for removable mounting in a carrying case having a primary receptacle, comprising:

a rectangular pocket back panel having a front face and a back face, at least two open mesh pockets on the front face of said pocket back panel, the open mesh pockets having openings oriented in a common direction;

a first removable auxiliary case in each open mesh pocket, each first removable auxiliary case formed of a first primary shell of pliable material, the primary shell formed of a pair of opposed half shells connected together for hinging along a common side and forming a receptacle, each half shell formed of a rectangular back panel with a bottom panel, a top panel and two end panels secured along the periphery of the back panel forming the receptacle, one of the opposed half shells having a transparent back panel; and each said first primary shell having an outer fastener so that the outer fastener provides a means for opening and securing each auxiliary case.

2. The multi-pocket assembly of claim 1 further comprising, at least a third open mesh pocket on the front face of said pocket back panel, the second removable auxiliary case open mesh pocket has an opening oriented in said common direction;

a second removable auxiliary case in the third open mesh pocket, the second removable auxiliary case formed of a second primary shell of pliable material, the primary shell formed of a pair of opposed half shells connected together for hinging along a common side and forming a receptacle, each half shell of the second primary shell formed of a rectangular back panel with a bottom panel, a top panel and two end panels secured along the periphery of the back panel forming the receptacle, one of the opposed half shells of the second primary shell having a transparent back panel.

3. The multi-pocket assembly of claim 2 wherein the at least two of said open mesh pockets are disposed side by side on said pocket back panel; and said third open mesh pocket extends substantially the width of said pocket back panel.

4. The multi-pocket assembly of claim 3, wherein said pocket back panel of said first multi-pocket assembly is foldable along two transverse fold lines defining three overlapping sub-panels of substantially equal dimensions and includes a first handle strap at a top of said back panel and a second handle strap adjacent a fold line on the back face of said pocket back panel thereby enabling said multi-pocket assembly to be folded with said overlapping sub-panels foldable with one of said sub-panels sandwiched between the other two sub panel and carried as a case by said first and second handle straps.

5. The multi-pocket assembly of claim 4 wherein said two of said open mesh pockets are disposed side by side on one of said sub-paniels of said pocket back panel; and said third open mesh pocket disposed on another of said sub-panels of said back panel whereby said open mesh pockets and auxiliary cases therein nestle together between said overlapping sub-panels are folded along said fold lines.

6. The multi-pocket assembly of claim 5 wherein said multi-pocket assembly comprises a jewelry case detachably mounted to said pocket back panel.

7. The multi-pocket assembly of claim 1 wherein said pocket back panel of said first multi-pocket assembly is foldable along two transverse fold lines defining three overlapping sub-panels of substantially equal dimensions defining a top sub-panel, a center sub-panel and a bottom sub-panel foldable with said bottom sub-panel sandwiched between said top sub panel and said center sub panel and comprises, a third open mesh pocket disposed on the front face of said pocket back panel, the third open mesh pocket has an opening oriented in said common direction.

8. The multi-pocket assembly of claim 7 wherein said multi-pocket assembly comprises a jewelry case detachably attachable to said pocket panel.

9. The multi-pocket assembly of claim 8 wherein:

said jewelry case comprises front and back panels connected together and foldable along common side edges; and at least one open mesh panel between said front and back panels of said jewelry case.

10. The multi-pocket assembly of claim 9, wherein:

said jewelry case comprises at least one pocket on its back panel; and at least one ring mounting stud on its back panel.

11. The multi-pocket assembly of claim 10 wherein said ring mounting stud is insertable in said pocket of said jewelry case.

12. The multi-pocket assembly use of claim 11, in combination with a carrying case comprising a primary shell of pliable material, the primary shell formed of a pair of substantially identical primary half shells connected together for hinging along a common side and forming a primary receptacle, each the primary half shells of the carrying case formed of a rectangular back panel with a bottom panel, a top panel and two end panels secured along the periphery of the back panel forming the primary receptacle; wherein the multi-pocket assembly is removably stowable within the carrying case.

13. The multi-pocket assembly of claim 12, wherein the combination further comprises a second multi-pocket assembly comprising:

a foldable closure pocket panel and a front pocket panel, the front pocket including a pleated pocket panel section that forms a plurality pockets having an open top being generally the same length and shaped and configured to receive articles, the foldable closure pocket panel is transparent;

the foldable closure pocket panel configured to simultaneously overlap and close the open top of the plurality of pockets to secure the articles there within, the foldable closure pocket panel is detachably secured over the front pocket panel by a hook and loop fastener; and means for hanging the foldable pocket panel from a hook.

14. A carrying case and multi-pocket assembly, comprising:

a carrying case comprising a first primary shell of pliable material, the first primary shell formed of a pair of substantially identical first primary half shells connected together for hinging along a common side and forming a primary receptacle, each the primary half shell formed of a rectangular back panel with a bottom panel, a top panel and two end panels secured along the periphery of the back panel forming the primary receptacle; and at least a first multi-pocket assembly device of pliable material that is removable and stores within the carrying case, the at least one multi-pocket assembly device comprising a rectangular pocket back panel having a front face and a back face, at least two open mesh pockets on the front face of said pocket back panel, and the open mesh pockets on the pocket back panel have openings oriented in a common direction;

a first removable auxiliary case in each open mesh pocket, each first auxiliary case formed of a second primary shell of pliable material, the second primary shell formed of a pair of opposed half shells connected together for hinging along a common side and forming a receptacle, each half shell of the second primary shell formed of a rectangular back panel with a bottom panel, a top panel and two end panels secured along the periphery of the back panel forming the receptacle, one of the opposed half shells of the second primary shell having a transparent back panel; and each said second primary shell having an outer fastener so that the outer fastener provides a means for opening and securing each auxiliary case.

15. The multi-pocket assembly of claim 14 further comprising, at least a third open mesh pocket on the front face of said pocket back panel, the third open mesh pocket has an opening oriented in said common direction;

a second removable auxiliary case in the third open mesh pocket, the second auxiliary case formed of a third primary shell of pliable material, the third primary shell formed of a pair of opposed half shells connected together for hinging along a common side and forming a receptacle, each half shell of the third primary shell formed of a rectangular back panel with a bottom panel, a top panel and two end panels secured along the periphery of the back panel forming the receptacle, one of the opposed half shells of the third primary shell having a transparent back panel.

16. The multi-pocket assembly of claim 15 wherein the at least two of said open mesh pockets are disposed side by side on said back panel; and said third open mesh pocket extends substantially the width of said back panel.

17. The multi-pocket assembly of claim 14, wherein said pocket back panel of said first multi-pocket assembly is foldable along two transverse fold lines defining three overlapping sub-panels including a top, a bottom and a center sub-panel of substantially equal dimensions foldable into face to face relation with said bottom panel sandwiched between said the top and center panels and includes a first handle strap at a top of said back panel and a second handle strap adjacent a fold line on the back face of said back panel thereby enabling said multi-pocket assembly to be folded and carried as a case by said first and second handle straps.

18. The multi-pocket assembly of claim 17 wherein said two of said open mesh pockets are disposed side by side on one of said sub-panels of said back panel; and a third open mesh pocket is disposed on another of said sub-panels of said back panel whereby said open mesh pockets and auxiliary cases therein nestle together between said overlapping sub-panels when said sub-panels are folded along said fold lines into a face to face relation.

19. The multi-pocket assembly of claim 14 wherein said multi-pocket assembly comprises a jewelry case detachably mounted to said back pocket panel.

20. The multi-pocket assembly of claim 19 wherein:

said jewelry case comprises front and back panels connected together and foldable along common side edges; and at least one open mesh panel between said front and back panels of said jewelry case.

21. The multi-pocket assembly of claim 20, wherein:

said jewelry case comprises at least one pocket on its back panel; and at least one ring mounting stud on its back panel.

22. The multi-pocket assembly of claim 21 wherein said ring mounting stud is insertable in said pocket of said jewelry case.

* * * * *